US008920070B2

(12) United States Patent
Zimmermann et al.

(10) Patent No.: US 8,920,070 B2
(45) Date of Patent: Dec. 30, 2014

(54) SLIPFORM PAVER

(75) Inventors: Markus Zimmermann, Linz/Rhein (DE); Ralf Schug, Buerdenbach (DE); Cyrus Barimani, Koenigswinter (DE); Guenter Haehn, Koenigswinter (DE)

(73) Assignee: Wirtgen GmbH (DE)

( * ) Notice: Subject to any disclaimer, the term of this patent is extended or adjusted under 35 U.S.C. 154(b) by 0 days.

(21) Appl. No.: 13/292,271

(22) Filed: Nov. 9, 2011

(65) Prior Publication Data

US 2012/0128417 A1 May 24, 2012

(30) Foreign Application Priority Data

Nov. 19, 2010 (DE) ..... 10 2010 051 972

(51) Int. Cl.
*E01C 11/22* (2006.01)
*E01C 19/48* (2006.01)

(52) U.S. Cl.
CPC ..... *E01C 19/4893* (2013.01)
USPC ..... 404/98; 404/84.05; 404/84.8

(58) Field of Classification Search
USPC ..... 404/98, 83, 84.05, 84.8, 96, 104
See application file for complete search history.

(56) References Cited

U.S. PATENT DOCUMENTS

| | | | | |
|---|---|---|---|---|
| 3,605,581 | A * | 9/1971 | Heaton | 404/98 |
| 3,625,121 | A | 12/1971 | Blumer et al. | |
| 3,635,131 | A * | 1/1972 | Larsen et al. | 404/84.1 |
| 3,680,451 | A * | 8/1972 | Birtchet | 404/104 |
| 3,710,695 | A * | 1/1973 | Miller et al. | 404/98 |
| 3,779,662 | A * | 12/1973 | Smith | 404/98 |
| 3,915,582 | A | 10/1975 | Clarke | |
| 3,915,583 | A * | 10/1975 | Aparicio | 404/98 |
| 3,936,211 | A * | 2/1976 | Miller et al. | 404/104 |
| 3,954,359 | A * | 5/1976 | Larkin | 425/63 |
| 4,013,375 | A * | 3/1977 | Heaton | 404/98 |
| 4,041,623 | A | 8/1977 | Miller et al. | |
| 4,093,410 | A | 6/1978 | Miller | |
| 4,319,859 | A * | 3/1982 | Wise | 405/268 |
| 5,173,005 | A * | 12/1992 | Henderson et al. | 404/98 |
| 5,662,431 | A | 9/1997 | Colvard | |
| 6,109,825 | A | 8/2000 | Yon | |
| 7,377,719 | B1 * | 5/2008 | Elizondo et al. | 404/98 |
| 7,441,987 | B1 * | 10/2008 | Sampey | 404/98 |
| 8,221,026 | B2 * | 7/2012 | Munz et al. | 404/96 |
| 2002/0187004 | A1 * | 12/2002 | Casters | 404/96 |

FOREIGN PATENT DOCUMENTS

| | | | |
|---|---|---|---|
| DE | 2739452 | A1 | 7/1978 |
| DE | 19644397 | A1 | 4/1997 |
| DE | 19952697 | A1 | 2/2001 |

* cited by examiner

*Primary Examiner* — Matthew D Troutman
(74) *Attorney, Agent, or Firm* — Waddey & Patterson, P.C.; Lucian Wayne Beavers

(57) ABSTRACT

A slipform paver includes a chassis 2 able to be adjusted in the heightwise direction and having a mounting unit 10 arranged on the chassis for fastening on an arrangement 8 for molding flowable material. The slipform paver is characterised in that the mounting unit 10 for fastening on the concrete mold 8 is mounted on the chassis 2 of the paver to be pivotable on an axis 14 extending in the direction of operation of the slipform paver. To produce parts of a structure whose orientation varies along their length, the concrete mold fastened 8 to the mounting unit is pivoted on the axis of pivot 14 by means of a pivoter unit 15 whereas the chassis of the paver maintains its orientation.

31 Claims, 4 Drawing Sheets

SLIPFORM PAVER

FIELD OF THE INVENTION

The invention relates to a slipform paver having a chassis able to be adjusted in the heightwise direction and having a mounting unit arranged on the chassis for fastening on an arrangement for molding flowable material. As well as this, the invention also relates to a slipform paver having an arrangement for molding flowable material.

DESCRIPTION OF THE PRIOR ART

With known slipform pavers, parts of a structure can be produced continuously from a flowable material and in particular from concrete. The known slipform pavers have an arrangement in which the flowable material is formed to the desired shape. An arrangement of this kind for molding the flowable material is also referred to as a concrete mold. For parts of structures of different cross-sections to be produced, the concrete molds have to be changed over. The known slipform pavers therefore have a mounting unit to which concrete molds of different types can be fastened.

The chassis of the known slipform pavers is connected to track-laying running gear units via lifting columns. The chassis of the paver can be adjusted in the heightwise direction by withdrawing and extending the lifting columns. When this is done, the chassis of the paver can be raised or lowered on the side which is on the right or left in the direction of operation or can be raised or lowered at the end which is at the front or rear in the direction of operation. Because the concrete mold is solidly connected to the chassis of the paver, the orientation of the chassis of the paver also determines the orientation of the concrete mold.

U.S. Pat. No. 6,109,825 describes a slipform paver having a concrete mold, whose chassis can be adjusted in the heightwise direction on lifting columns.

Known slipform pavers allow parts of a structure whose orientation varies continuously along their length to be produced. The outline or cross-section of the parts of a structure also varies continuously along their length if it is assumed that the ground on which the part of a structure is to be laid is level. With known slipform pavers, it is for example possible to produce road gutters which have amongst other things an inner face adjacent the surface of the road and whose inclination varies continuously along the road. In the region of the drainage outlets, the inner face lies in the plane of the road whereas between the drainage outlets the face is inclined inwards relative to the road. The face may be at its greatest inclination halfway between the drainage outlets.

To produce road gutters whose orientation varies continuously, it is necessary for the orientation of the chassis of the slipform paver to be varied continuously while the paver is advancing. While the slipform paver is moving along a reference, such for example as along a string line, the lifting columns on the left and right in the direction of operation are continuously extended or withdrawn to tilt the concrete mold to the desired position. It is a disadvantage that, due to the relatively long distance from the lifting columns, even relatively small inclinations of the concrete mold call for relatively large tilting movement of the chassis of the paver. The continuous tilting of the chassis of the paver while being used in operation not only makes the conditions under which the driver of the paver is working more difficult but also results in unnecessary wear on the lifting columns as they perform the relatively large lifting movements. What is more, the tilting movements of the chassis of the paver result in an unwanted sloping position for the conveyor belt of the feeding arrangement of the slipform paver for charging the concrete mold with concrete.

SUMMARY OF THE INVENTION

The object underlying the invention is to provide a slipform paver which in particular allows the working conditions to be improved for the driver of the paver.

The slipform paver according to the invention has a drive unit having drive means for causing movements in translation and/or in rotation to be performed and a control unit which is so designed that the drive means of the drive unit are actuated to cause the movements in translation and/or in rotation to be performed. The drive means of the drive unit may comprise the known lifting columns and track-laying running gear units.

The slipform paver according to the invention is characterised in that the mounting unit for fastening on an arrangement for molding flowable material is mounted on the chassis of the paver to be pivotable on an axis extending in the direction of operation of the slipform paver. The slipform paver has a pivoter unit which has drive means for pivoting the mounting unit on the axis of pivot extending in the direction of operation. To produce parts of a structure whose orientation varies along their length, the arrangement for molding flowable material which is fastened to the mounting unit is pivoted on the axis of pivot by means of the pivoter unit while the chassis of the paver maintains its orientation. Consequently, the production of the part of a structure does not call for a change in the orientation of the chassis of the paver. Because the chassis of the paver maintains its orientation, the working conditions are improved for the driver of the paver. As well as this, there is also less wear on the lifting columns because the lifting columns do not have to be extended and withdrawn. Furthermore, an unwanted sloping position is avoided for the conveyor belt of the feeding arrangement for charging the concrete mold with concrete.

What is meant by the mounting unit for fastening on the arrangement for molding flowable material is, in particular, a unit by which concrete molds of different types can be interchanged quickly. Changeover arrangements of this kind for concrete mold are familiar to the person skilled in the art. What is meant by a mounting unit may however also be a unit which does not allow the concrete mold to be changed quickly. Hence, the concrete mold may also in principle be connected to the chassis of the paver without being able to be exchanged.

To cause the mounting unit to perform pivoting movements, the drive means of the pivoter unit are preferably actuated by the central control unit of the slipform paver, which also actuates the drive means of the drive unit to cause the movements in translation and/or rotation to be performed.

A preferred embodiment makes provision for the drive means of the pivoter unit to be actuated to cause the pivoting movements to be performed in a preset movement process in order to make the part of a structure being produced of the desired shape. To produce road gutters, the preset movement process comprises a pivoting movement of the mounting unit on the axis of pivot extending in the direction of operation of the slipform paver from a neutral position which may correspond to a horizontal or substantially horizontal orientation of the concrete mold to a sloping position and from the sloping position back to the neutral position. The preset movement process may also comprise a sequence of such pivoting movements. It is possible in this way to produce road gutters whose faces adjacent the road surface are inclined between the drainage outlets and not inclined at the drainage outlets.

An embodiment of the control unit which is a particular preference makes provision for the individual pivoting movements in the sequence of pivoting movements to be performed within an interval of time in which the slipform paver covers a preset distance of travel. When road gutters are being produced, the preset distance of travel between the individual pivoting movements may correspond to the spacings between the drainage outlets in the road gutters.

The drive means of the pivoter unit may be of different designs. The pivoter unit may for example have hydraulic and/or pneumatic and/or electric motor drive means. The pivoter unit preferably has hydraulic drive means.

The mounting unit preferably has fastening means which co-operate with complementary fastening means belonging to a mounting unit of an arrangement for molding flowable material, to allow the arrangement for molding flowable material to be exchanged. The fastening means are preferably arranged on a mounting plate belonging to the mounting unit which is mounted to be pivotable on an axis extending in the direction of operation of the slipform paver, the drive means of the pivoter unit engaging with the mounting plate.

As well as performing the pivoting movement on the axis extending in the direction of operation of the slipform paver, the mounting unit may also be arranged on the chassis of the paver to be adjustable in the heightwise direction and/or along an axis extending transversely to the direction of operation of the slipform paver, to allow the mounting unit, or in other words the concrete mold, to be moved otherwise than in the pivoting movements.

A preferred embodiment of the control unit makes provision for an arrangement for adjusting the mounting unit along an axis extending transversely to the direction of operation of the slipform paver and/or for adjusting the mounting unit in the heightwise direction to be able to be actuated.

An embodiment of the control unit which is a particular preference also makes provision for the control unit to be so designed that, by adjusting the mounting unit, any desired reference point on the concrete mold remains at a constant horizontal and/or vertical distance from a reference. Deviations from the desired horizontal and/or vertical distance caused by the pivoting of the mounting unit can be compensated for in this way. The concrete mold then pivots on, as it were, an axis of this reference point able to be selected as desired which extends in the direction of operation of the slipform paver.

In what follows, an embodiment of the invention will be explained in detail by reference to the drawings.

DETAILED DESCRIPTION

Figure 1:
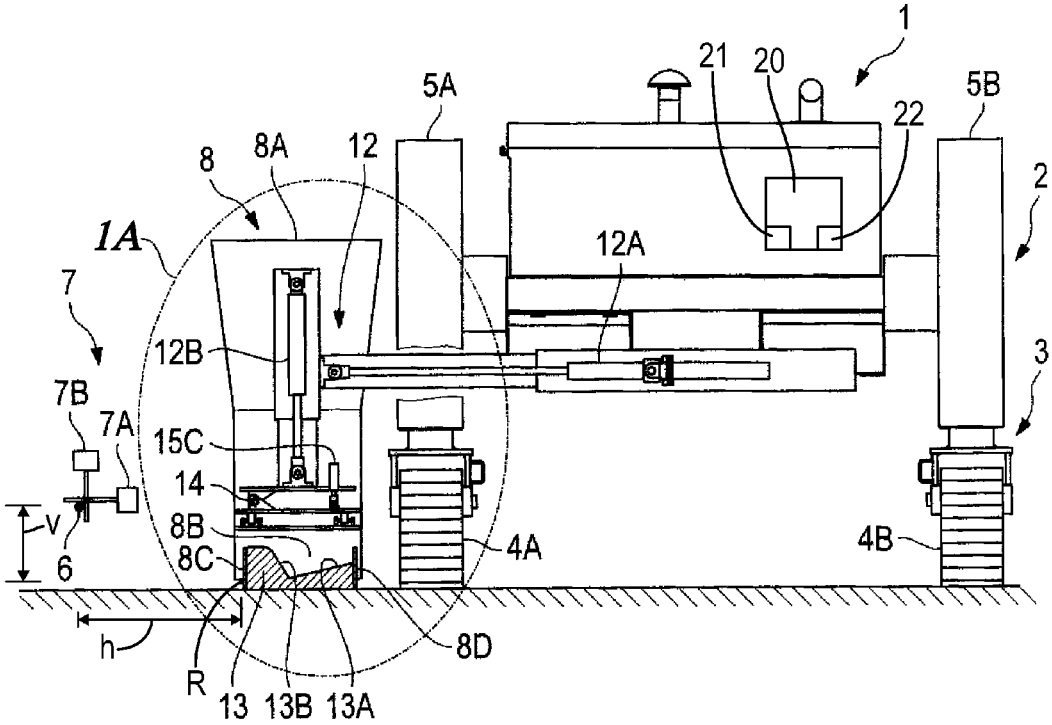
FIG. 1 is a schematic view of a slipform paver which has an arrangement for molding flowable material.
Figure 1A:
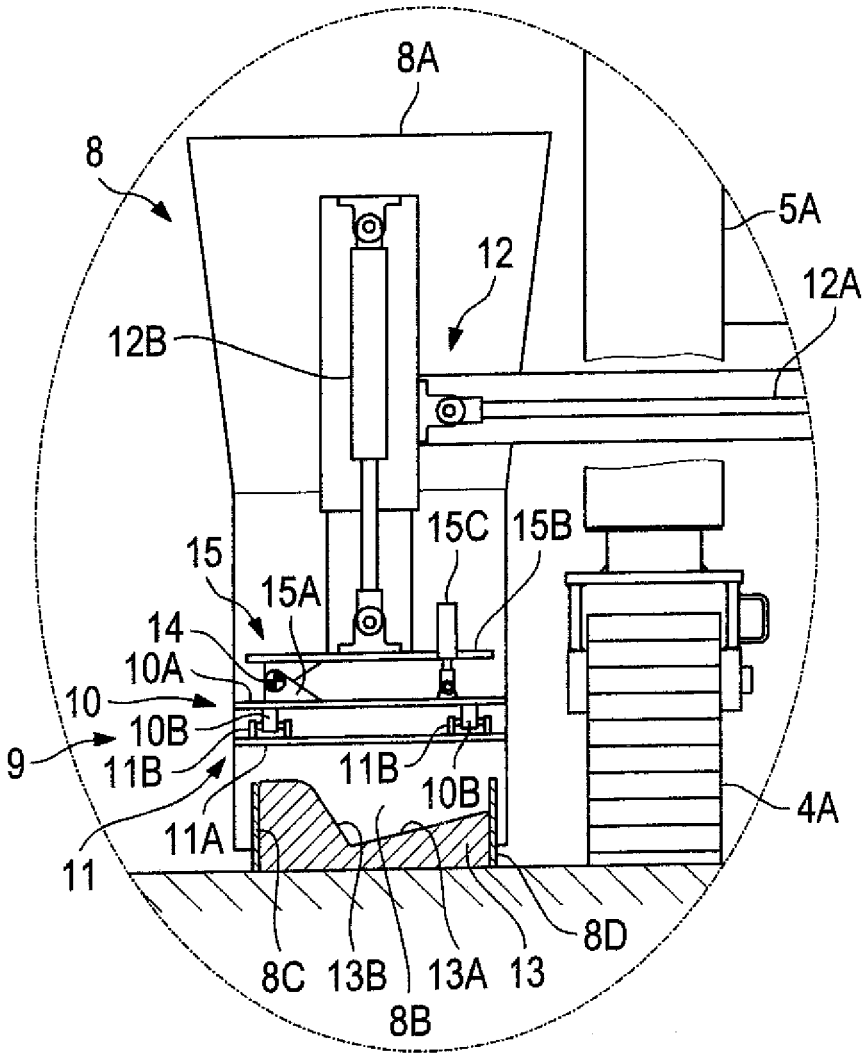
FIG. 1A is an enlarged view of detail A of the slipform paver shown in FIG. 1.

FIG. 1 is a view of the slipform paver from the rear. Because slipform pavers as such are part of the prior art, all that will be described here are the components of the civil engineering machine which are material to the invention.

The slipform paver 1 has a chassis 2 which is carried by running gear. The running gear has a track-laying running gear unit which is at the left front in the direction of operation of the slipform paver and a track-laying running gear unit 4A which is at the left rear in the direction of operation, and a track-laying running gear unit which is at the right front in the direction of operation and a track-laying running gear unit 4B which is at the right rear in the direction of operation, which track-laying running gear units are fastened to front and rear lifting columns 5A on the left and front and rear lifting columns 5B on the right. The direction of operation of the slipform paver points into the plane of the drawing.

The track-laying running gear units 4A, 4B and the lifting columns 5A, 5B form the drive means of a drive unit 3 for causing the slipform paver to perform movements in translation and/or in rotation. By raising and lowering of the lifting columns 5A, 5B, the chassis 2 of the paver can be adjusted in the heightwise direction relative to the ground. When this done, the chassis 2 of the paver can be inclined relative to the ground in different directions. With the track-laying running gear units 4A, 4B, the civil engineering machine can be moved in different directions.

To cause the movements in translation and/or rotation to be performed, the drive means 4A, 4B, 5A, 5B can be actuated by a central control unit (20 schematically shown in FIG. 1). The control unit 20 actuates the drive means in such a way that the slipform paver follows a string line 6 tensioned in the direction of operation. Rather than a string line, the slipform paver may also follow some other reference which may even already be present on the ground such for example as a curb or a crash barrier. The slipform paver has a sensing arrangement 7 which is only indicated and which has a horizontal and a vertical sensing member 7A, 7B which sense the string line 6 in the horizontal and vertical directions. A slipform paver having a sensing arrangement of this kind is known for example from U.S. Pat. No. 4,041,623.

The slipform paver has an arrangement 8 for molding flowable material, and in particular concrete, which will be referred to in what follows as a concrete mold 8. On the left-hand side of the slipform paver in the direction of operation, the exchangeable concrete mold 8 is detachably fastened to the chassis 2 of the paver by a quick-change system 9.

The concrete mold 8 has a chute 8A which is used for the infeed of concrete by a feeding arrangement (not shown) belonging to the slipform paver, and a mold proper 8B arranged underneath the chute which is bounded by lateral plates 8C, 8D. The mold quick-change system 9 has a mounting unit 10 associated with the chassis 2 of the paver and a mounting unit 11 associated with the concrete mold 8. The mounting unit 10 belonging to the chassis 2 of the paver and the mounting unit 11 belonging to the concrete mold 8 have respective mounting plates 10A and 11A on which are arranged respective fastening means 10B and 11B which interengage when the concrete mold is locked to the chassis 2 of the paver. A slipform paver having a quick-change system of this kind for fastening on the concrete mold is described for example in DE 196 44 397 A1 or U.S. Pat. No. 5,662,431.

The mounting unit 10 of the slipform paver is adjustable on the chassis 2 of the paver both in the heightwise direction and along an axis extending transversely to the direction of operation by an adjustment arrangement 12. The sideways adjustment is made by means of a horizontal piston-and-cylinder arrangement 12A and the adjustment in the heightwise direction by means of a vertical piston-and-cylinder arrangement 12B. The concrete mold can thus be moved in such a way that a reference point (R) which can be selected as desired on the concrete mold retains at a constant horizontal distance (h) from the string line 6 and/or a constant vertical distance (v) therefrom. The concrete mold cannot however be placed in a sloping position relative to the chassis of the paver by the adjustment arrangement 12.

The slipform paver is used in particular for the production of parts of a structure whose orientation varies continuously in the direction of operation. These include in particular road gutters 13 which have an inner face 13A adjacent the surface of the road and an outer face 13B remote from the surface of the road.

The mounting unit 10 of the slipform paver is mounted on the chassis 2 of the paver to be pivotable on an axis 14 extending in the direction of operation of the slipform paver. The slipform paver has a pivoter unit 15 by which the concrete mold 8 can be pivoted on the axis of pivot 14. The pivoter unit 15 has a mounting 15A by which the left-hand side of the mounting plate 10A of the mounting unit 10 is pivotably fastened to the left-hand side of a fastening plate 15B which is connected to the piston of the vertical piston-and-cylinder arrangement 12B of the arrangement 12 for adjusting the concrete mold. As well as this, the pivoter unit 15 also has an actuator or drive means, and in particular a hydraulic piston-and-cylinder arrangement 15C whose piston is fastened to the side of the mounting plate 10A which is on the right in the direction of operation and whose cylinder is fastened to the right-hand side of the fastening plate 15B. The concrete mold 8 can be pivoted on the axis of pivot 14 by moving the piston of the piston-and-cylinder arrangement 15C in or out.

FIG. 1 shows the neutral position in which the concrete mold is not pivoted. When the piston of the piston-and-cylinder arrangement 15C is moved fully in, the concrete mold is in the sloping position shown in FIG. 2, whereas the concrete mold is in the sloping position shown in FIG. 3 when the piston is moved fully out. The concrete mold may also assume other, intermediate, positions. In the position shown in FIG. 2, the inner face of the mold proper 8B of the concrete mold 8 is at a smaller inclination than in the sloping position shown in FIG. 3. Hence, by moving the piston of the piston-and-cylinder arrangement 15C in and out, the orientation of the road gutter 13, which corresponds to the mold proper 8B of the concrete mold 8, can be varied continuously during the advance of the slipform paver.

The piston-and-cylinder arrangement 15C of the pivoter unit 15 is actuated by the central control unit 20 of the slipform paver. The central control unit is so designed that a given movement process can be preset for the pivoting movement of the mounting unit 10. This movement process is a sequence of pivoting movements, the concrete mold 8 being pivoted, in each pivoting movement, continuously from the position shown in FIG. 2 to the position shown in FIG. 3 and from the position shown in FIG. 3 to the position shown in FIG. 2, and so on, thus causing the inclination of the inner face 13B of the road gutter 13 to be varied continuously as the slipform paver advances. The data which defines the movement process may be stored in a memory 21 of the central control unit. The data may also be read in and/or read out to and/or from the memory 21 of the control unit 20 by using an input and output unit 22.

Figure 2:
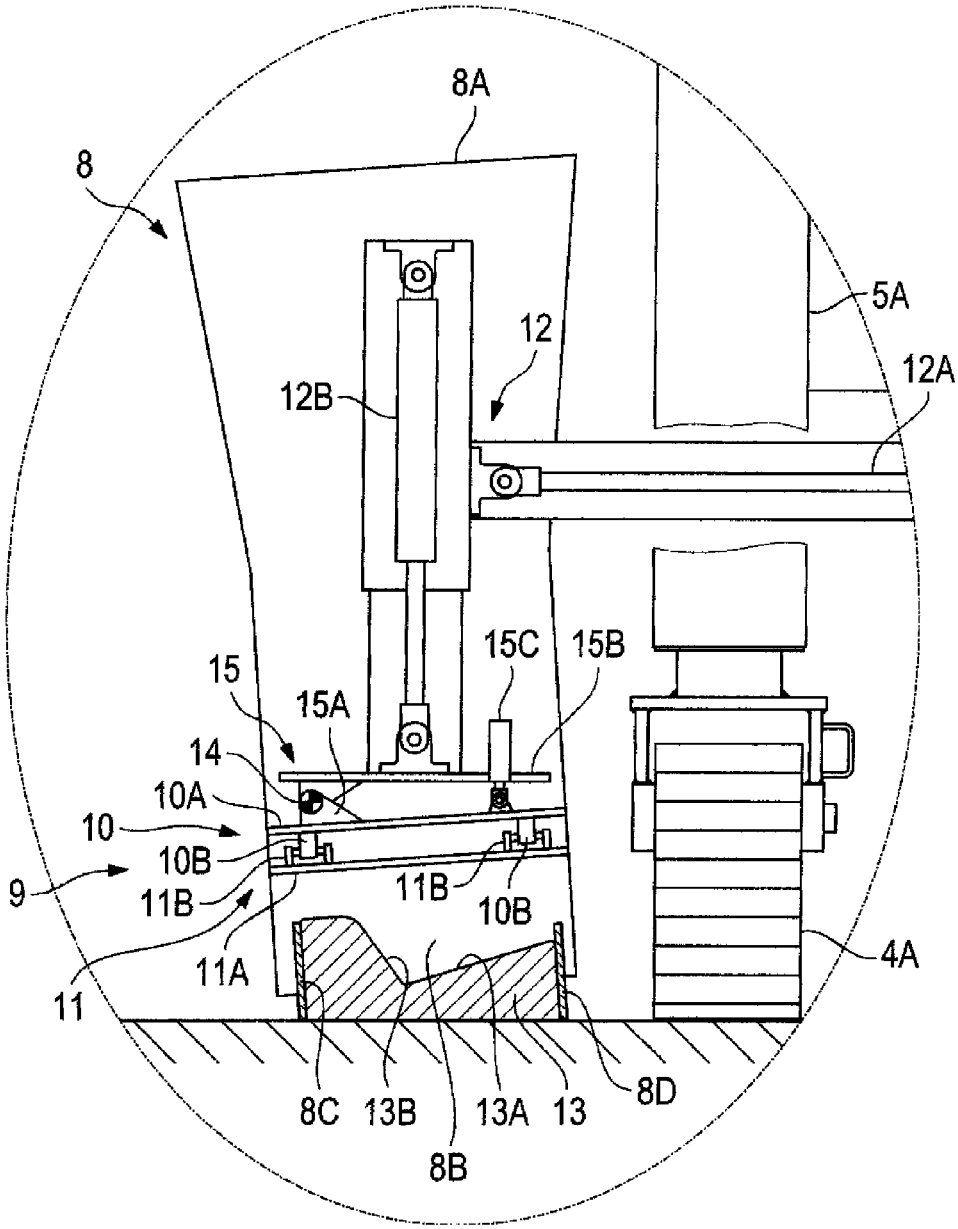
FIG. 2 is an enlarged view of detail A of the slipform paver shown in FIG. 1 in which the arrangement for molding flowable material is pivoted to a first position.
Figure 3:
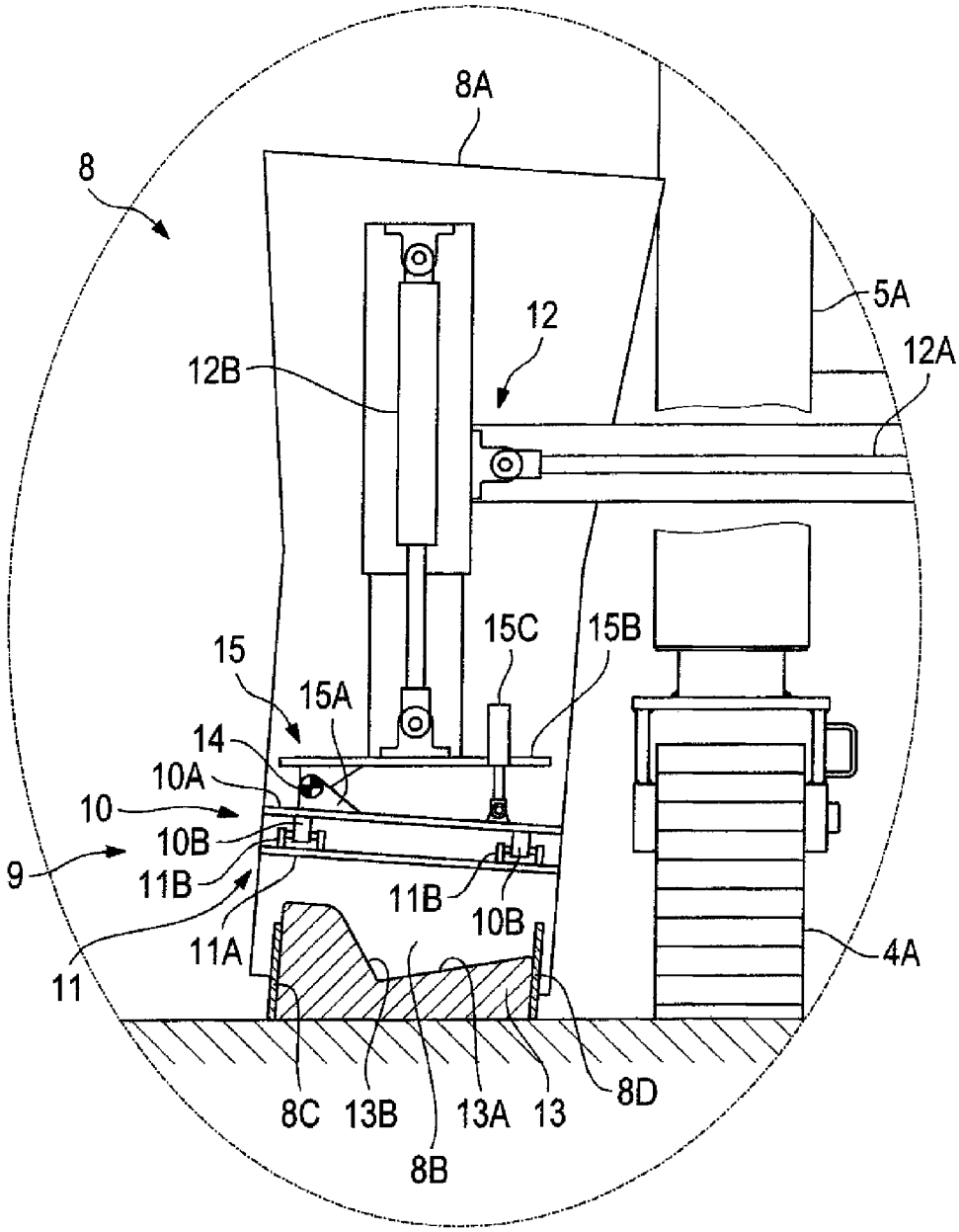
FIG. 3 is an enlarged view of detail A of the slipform paver shown in FIG. 1 in which the arrangement for molding flowable material is pivoted to a second position.

As well as this, the control unit is also so designed that the pivoting movement from the position shown in FIG. 2 to the position shown in FIG. 3, or vice versa, takes place in an interval of time in which the slipform paver covers a preset distance of travel. This distance of travel corresponds to the preset spacing between the drainage outlets in the road gutter. The data required for determining the distance of travel covered is supplied to the control unit by a distance-of-travel sensor (not shown in the drawings) which is generally present anyway in known slipform pavers.

What is claimed is:

1. A slipform paver apparatus, comprising:

a chassis having a direction of operation;

left and right lifting columns configured to adjust the chassis in a heightwise direction;

a drive unit configured to cause the chassis to perform movements in translation and/or rotation;

a control unit configured to actuate the drive unit;

a mounting unit configured to mount a mold for molding flowable material such that the entire mold is movable with the mounting unit, the mounting unit being pivotably connected to the chassis for pivoting about an axis extending in the direction of operation;

a pivoter unit connected to the mounting unit and configured to pivot the mounting unit about the axis extending in the direction of operation, so as to tilt the mounting unit without adjusting the lifting columns; and an adjustment arrangement connected between the chassis and the mounting unit for adjusting a position of the mounting unit relative to the chassis;

wherein the control unit is operably associated with the pivoter unit and configured to automatically actuate the pivoter unit to cause the mounting unit and the entire mold to perform automatic pivoting movements about the axis relative to the chassis.

2. The apparatus of claim 1, wherein:

the control unit is configured such that the pivoter unit is actuated to cause the pivoting movements of the mounting unit to be performed in a preset movement process.

3. The apparatus of claim 1, wherein:

the pivoter unit includes a drive actuator selected from the group consisting of hydraulic, pneumatic and electric drive actuators.

4. The apparatus of claim 1, wherein:

the mounting unit includes a first fastener configured to cooperate with a complementary second fastener located on the mold.

5. The apparatus of claim 1, wherein:

the adjustment arrangement is configured such that the mounting unit position relative to the chassis is adjustable independently both in a heightwise direction and in a transverse direction transverse to the direction of operation.

6. The apparatus of claim 5, wherein:

the control unit is operably associated with the adjustment arrangement and configured to actuate the adjustment arrangement to adjust the mounting unit position in the heightwise direction and in the transverse direction.

7. The apparatus of claim 6, wherein:

the control unit is configured such that the adjustment arrangement adjusts the mounting unit such that any desired reference point on the mold remains at a constant horizontal and/or vertical distance from a reference.

8. The apparatus of claim 1, further comprising:

a mold for molding flowable material, the mold being mounted on the mounting unit.

9. A slipform paver apparatus comprising:

a chassis having a direction of operation;

left and right lifting columns configured to adjust the chassis in a heightwise direction;

a drive unit configured to cause the chassis to perform movements in translation and/or rotation;

a control unit configured to actuate the drive unit;

a mounting unit configured to mount a mold for molding flowable material, the mounting unit being pivotable connected to the chassis for pivoting about an axis extending in the direction of operation;

a pivoter unit connected to the mounting unit and configured to pivot the mounting unit about the axis extending in the direction of operation, so as to tilt the mounting unit without adjusting the lifting columns;

wherein the control unit is operably associated with the pivoter unit and configured to automatically actuate the pivoter unit to cause the mounting unit to perform automatic pivoting movements about the axis relative to the chassis;

wherein the control unit is configured such that the pivoter unit is actuated to cause the pivoting movements of the mounting unit to be performed in a preset movement process; and wherein the control unit is configured such that the preset movement process comprises a pivoting movement of the mounting unit on the axis from a neutral position to a sloping position and from the sloping position to the neutral position.

10. A slipform paver apparatus, comprising:

a chassis having a direction of operation;

left and right lifting columns configured to adjust the chassis in a heightwise direction;

a drive unit configured to cause the chassis to perform movements in translation and/or rotation;

a control unit configured to actuate the drive unit;

a mounting unit configured to mount a mold for molding flowable material, the mounting unit being pivotable connected to the chassis for pivoting about an axis extending in the direction of operation;

a pivoter unit connected to the mounting unit and configured to pivot the mounting unit about the axis extending in the direction of operation, so as to tilt the mounting unit without adjusting the lifting columns;

wherein the control unit is operable associated with the pivoter unit and configured to automatically actuate the voter unit to cause the mounting unit to perform automatic pivoting movements about the axis relative to the chassis;

wherein the control unit is configured such that the pivoter unit is actuated to cause the pivoting movements of the mounting unit to be performed in a preset movement process; and wherein the control unit is configured such that the preset movement process comprises a sequence of pivoting movements on the axis from a neutral position to a sloping position and from the sloping position to the neutral position.

11. The apparatus of claim 10, wherein:

the control unit is configured such that individual pivoting movements in the sequence of pivoting movements are performed within an interval of time in which the slipform paver covers a preset distance of travel.

12. A slipform paver apparatus, comprising:

a chassis having a direction of operation;

left and right lifting columns configured to adjust the chassis in a heghtwise direction;

a drive unit configured to cause the chassis to perform movements in translation and/or rotation;

a control unit configured to actuate the drive unit;

a mounting unit configured to mount a mold for molding flowable material the mounting unit being pivotable connected to the chassis for pivoting about an axis extending in the direction of operation; and a pivoter unit connected to the mounting unit and configured to pivot the mounting unit about the axis extending in the direction of operation so as to tilt the mounting unit without adjusting the lifting columns;

wherein:

the control unit is operably associated with the pivoter unit and configured to automatically actuate the pivoter unit to cause the mounting unit to perform automatic pivoting movements about the axis relative to the chassis;

the mounting unit includes a first fastener configured to cooperate with a complementary second fastener located on the mold;

the mounting unit includes a mounting plate pivotably connected to the chassis for pivoting about the axis;

the first fastener is attached to the mounting plate; and the pivoter unit includes a drive actuator connected to the mounting plate.

13. A slipform paver apparatus, comprising:

a chassis having a direction of operation;

left and right lifting columns configured to adjust the chassis in a heightwise direction;

a mounting unit configured to mount a mold for molding flowable material, the mounting unit being pivotably connected to the chassis for pivoting about an axis extending in the direction of operation;

an actuator connected to the mounting unit and configured to pivot the mounting unit about the axis extending in the direction of operation, so as to tilt the mounting unit without adjusting the lifting columns; and a control unit operably associated with the actuator and configured to automatically actuate the actuator to cause the mounting unit to perform automatic pivoting movements about the axis relative to the chassis;

wherein the mounting unit comprises a quick change mounting unit configured to allow changing of a mold mounted on the mounting unit.

14. The apparatus of claim 13, wherein:

the control unit is configured such that the actuator is actuated to cause pivoting movements of the mounting unit to be performed in a predetermined sequence.

15. The apparatus of claim 13, wherein:

the actuator is selected from the group consisting of hydraulic, pneumatic and electric drive actuators.

16. The apparatus of claim 13, wherein:

the mounting unit includes a first fastener configured to cooperate with a complementary second fastener located on the mold.

17. The apparatus of claim 13, further comprising:

a mold for molding flowable material, the mold being mounted on the mounting unit.

18. A slipform paver apparatus, comprising:

a chassis having a direction of operation;

left and right lifting columns configured to adjust the chassis in a heghtwise direction;

a mounting unit configured to mount a mold for molding flowable material, the mounting unit being pivotably connected to the chassis for pivoting about an axis extending in the direction of operation;

an actuator connected to the mounting unit and configured to pivot the mounting unit about the axis extending in the direction of operation, so as to tilt the mounting unit without adjusting the lifting columns; and a control unit operably associated with the actuator and configured to automatically actuate the actuator to cause the mounting unit to perform automatic pivoting movements about the axis relative to the chassis;

wherein the control unit is configured such that the actuator is actuated to cause pivoting movements of the mounting unit to be performed in a predetermined sequence; and wherein the control unit is configured such that the predetermined sequence comprises a plurality of cycles of pivoting movements of the mounting unit on the axis, each cycle including pivoting movement from a first position to a second position and back to the first position.

19. The apparatus of claim 18, wherein:

the control unit is configured such that each cycle in the predetermined sequence is performed within an interval of time in which the slipform paver covers a predetermined distance of travel.

20. A slipform paver Apparatus, comprising:

a chassis having a direction of operation;

left and right lifting columns configured to adjust the chassis in a heightwise direction;

a mounting unit configured to mount a mold for molding flowable material, the mounting unit being pivotably connected to the chassis for pivoting about an axis extending in the direction of operation;

an actuator connected to the mounting unit and configured to pivot the mounting unit about the axis extending in the direction of operation so as to tilt the mounting unit without adjusting the lifting columns; and a control unit operably associated with the actuator and configured to automatically actuate the actuator to cause the mounting unit to perform automatic pivoting movements about the axis relative to the chassis;

wherein:

the mounting unit includes a first fastener configured to cooperate with a complementary second fastener located on the mold;

the mounting unit includes a mounting plate pivotably connected to the chassis for pivoting about the axis;

the first fastener is attached to the mounting plate; and the actuator is connected to the mounting plate.

21. A slipform paver apparatus, comprising:

a chassis having a direction of operation;

left and right lifting columns configured to adjust the chassis in a heightwise direction;

a mounting unit configured to mount a mold for molding flowable material, the mounting unit being pivotably connected to the chassis for pivoting about an axis extending in the direction of operation;

an actuator connected to the mounting unit and configured to pivot the mounting unit about the axis extending in the direction of operation, so as to tilt the mounting unit without adjusting the lifting columns;

a control unit operably associated with the actuator and configured to automatically actuate the actuator to cause the mounting unit to perform automatic pivoting movements about the axis relative to the chassis; and an adjustment arrangement connected between the chassis and the mounting unit for adjusting a position of the mounting unit relative to the chassis.

22. The apparatus of claim 21, wherein:

the adjustment arrangement is configured such that the mounting unit position relative to the chassis is adjustable independently both in a heightwise direction and in a transverse direction transverse to the direction of operation.

23. The apparatus of claim 22, wherein:

the control unit is operably associated with the adjustment arrangement and configured to actuate the adjustment arrangement to adjust the mounting unit position in the heightwise direction and in the transverse direction.

24. The apparatus of claim 23, wherein:

the control unit is configured such that the adjustment arrangement adjusts the mounting unit such that any desired reference point on the mold remains at a constant horizontal and/or vertical distance from a reference.

25. A method of molding a structure from a flowable material, comprising:

(a) providing a mold pivotably mounted on a chassis so that the mold is pivotable about an axis extending parallel to a direction of travel of the chassis, the chassis being supported by left and right lifting columns;

(b) moving the chassis across a ground surface in the direction of travel and continuously molding a continuous structure with the mold; and (c) during step (b), pivoting the mold through a cycle from a first position to a second position and back to the first position relative to the chassis about the axis and varying an orientation of the continuous structure relative to the ground surface, without adjusting the lifting columns.

26. The method of claim 25, wherein:

step (c) further comprises repeating the cycle.

27. The method of claim 26, wherein:

in step (b) the structure is a gutter at an edge of a roadway, the gutter including a plurality of drains located at regular intervals; and step (c) further comprises synchronizing the repetition of the cycle with the location of the drains so that the gutter is inclined toward the drains at the location of the drains.

28. A method of molding a structure from a flowable material comprising:

(a) providing a mold pivotabley mounted on a chassis so that the mold is pivotable about an axis extending parallel to a direction of travel of the chassis, the chassis being supported by left and right lifting columns;

(b) moving the chassis across a ground surface in the direction of travel and continuously molding a continuous structure with the mold;

(c) during step (b), pivoting the mold relative to the chassis about the axis and varying an orientation of the continuous structure relative to the ground surface, without adjusting the lifting columns; and (d) adjusting a position of the mold relative to the chassis in a heightwise direction, independent of any adjustment of the position of the mold relative to the chassis in a transverse direction.

29. The method of claim 28, further comprising:

during said adjusting step, maintaining a reference point on the mold at a constant vertical distance from a reference.

30. A method of molding a structure from a flowable material, comprising:

(a) providing a mold pivotably mounted on a chassis so that the mold is pivotable about an axis extending parallel to a direction of travel of the chassis, the chassis being supported by left and right lifting columns;

(b) moving the chassis across a ground surface in the direction of travel and continuous molding a continuous structure with the mold;

(c) during step (b), pivoting the mold relative to the chassis about the axis and varying an orientation of the continuous structure relative to the ground surface, without adjusting the lifting columns; and (d) adjusting a position of the mold relative to the chassis in a transverse direction parallel to the ground surface and transverse to the direction of travel, independent of any adjustment of the position of the mold in a heightwise direction.

31. The method of claim 30, further comprising:

during said adjusting step, maintaining a reference point on the mold at a constant horizontal distance from a reference.

* * * * *

UNITED STATES PATENT AND TRADEMARK OFFICE

CERTIFICATE OF CORRECTION

PATENT NO. : 8,920,070 B2
APPLICATION NO. : 13/292271
DATED : December 30, 2014
INVENTOR(S) : Zimmermann et al.

It is certified that error appears in the above-identified patent and that said Letters Patent is hereby corrected as shown below:

In the Claims

Column 6, line 67, claim 9, replace “pivotable” with --pivotably--;
Column 7, line 29, claim 10, replace “pivotable” with --pivotably--;
Column 7, line 36, claim 10, replace “operable” with --operably--;
Column 7, line 38, claim 10, replace “voter” with --pivoter--;
Column 7, line 63, claim 12, after “material” insert --,--;
Column 7, line 63, claim 12, replace “pivotable” with --pivotably--;
Column 10, line 32, claim 28, replace “pivotabley” with --pivotably--.

Signed and Sealed this
Twenty-fifth Day of August, 2015

Michelle K. Lee

Michelle K. Lee
*Director of the United States Patent and Trademark Office*